United States Patent [19]

Waltenberger et al.

[11] 4,201,680

[45] * May 6, 1980

[54] SMOOTHING AGENTS FOR TREATING TEXTILE FIBER MATERIAL

[75] Inventors: Peter Waltenberger, Hilden; Günter Uphues; Manfred Petzold, both of Düsseldorf, all of Fed. Rep. of Germany

[73] Assignee: Henkel Kommanditgesellschaft auf Aktien, Düsseldorf-Holthausen, Fed. Rep. of Germany

[ * ] Notice: The portion of the term of this patent subsequent to Oct. 24, 1995, has been disclaimed.

[21] Appl. No.: 917,986

[22] Filed: Jun. 22, 1978

[30] Foreign Application Priority Data

Jul. 25, 1977 [DE] Fed. Rep. of Germany ..... 2733493

[51] Int. Cl.[2] ..... D06M 13/34

[52] U.S. Cl. ..... 252/8.6; 8/115.6; 252/8.8

[58] Field of Search ..... 252/8.6, 8.8; 8/115.6

[56] References Cited

U.S. PATENT DOCUMENTS

| | | | |
|---|---|---|---|
| 2,838,455 | 6/1958 | Tompkins | 252/8.6 |
| 3,658,717 | 4/1972 | Graff | 8/115.6 |
| 3,660,303 | 5/1972 | Hiesfand | 8/115.6 |
| 3,674,418 | 7/1972 | Lyons et al. | 8/115.6 |
| 3,775,051 | 11/1973 | Graff | 8/115.6 |
| 3,888,775 | 6/1975 | Koizumi et al. | 252/8.8 |
| 3,971,733 | 7/1976 | Hawkins | 252/8.6 |

*Primary Examiner*—William E. Schulz
*Attorney, Agent, or Firm*—Hammond & Littell, Weissenberger and Muserlian

[57] ABSTRACT

A smoothing agent for the treatment of textile fiber material comprising:

(Ia) from 0 to 50% by weight of a higher fatty acid ester from a fatty acid and a monohydric alcohol, (Ib) from 0 to 50% by weight of a higher fatty acid ester from 1 mole of a polyhydric alcohol and more than one mole of a fatty acid, (IIa) from 0 to 50% by weight of a paraffin having a melting point range of 40° to 60° C., (IIb) from 0 to 25% by weight of a liquid paraffin, the total of (Ia), (Ib), (IIa) and (IIb) being from 10–50% by weight, (III) from 1% to 10% by weight of a higher fatty acid amidopolyamine, (IV) from 0 to 5% by weight of higher fatty acid alkanolamides, (V) from 0 to 5% by weight of a quaternary ammonium salt, (VI) from 0 to 5% by weight of a nonionic ethoxylate, the total of (III), (IV), (V) and (VI) being from 1% to 12% by weight, (VII) from 0 to 1% by weight of a protective colloid, (VIII) from 0 to 10% by weight of a water-immiscible organic solvent, (IX) from 1% to 10% by weight of a lower carboxylic acid or lower hydroxycarboxylic acid, and (X) the remainder to 100% by weight of water.

15 Claims, No Drawings

SMOOTHING AGENTS FOR TREATING TEXTILE FIBER MATERIAL

THE RELATED ART

A known method of improving the smoothness of textile fiber material is that of so-called dry-paraffining in which the yarn to be treated is guided over solid paraffin during the spooling operation. A quantity of paraffin, dependent upon the type of paraffin, the contact pressure, and the speed of the material, is absorbed by the thread through abrading.

However, this method has substantial disadvantages. Thus, it is necessary to apply an accurately defined quantity of paraffin for the purpose of frictionless further processing of the textile material, different types of paraffin being used depending upon the time of the year. During spooling, it is necessary to reduce the normal spooling speed by 20% to 25%. Furthermore, the paraffined spools have to be stored at suitable temperatures.

During the paraffining operation, sliding of the individual strands of the yarn might occur and the threads might break during processing of the yarn, particularly, in the case of single ply yarns. A further disadvantage is the possible efflorescence of the paraffin during subsequent steaming and ironing processes.

Furthermore, the dry-paraffining operation is generally inadequate to impart a satisfactory feel to the material. This requires additional treatment with a conventional cationic brightener or scrooping agent.

The subject of U.S. Patent Application Ser. No. 797,045, filed May 16, 1977, now U.S. Pat. No. 4,122,018, is a smoothing agent for textile fiber material having the following composition:

(I) 5% to 20% by weight of a fatty acid ester from 1 mole of a fatty acid having 14 to 18 carbon atoms and 1 mole of a mono- or polyhydric alcohol having 1 to 8 carbon atoms, (II) 15% to 35% by weight of paraffin having a melting range of from 40° to 60° C., the total of (I) and (II) being 20% to 50% by weight, (III) 1% to 10% by weight of fatty acid amidopolyamine of the general formula

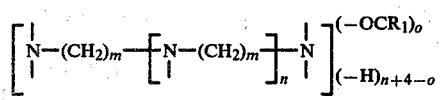

wherein —$OCR_1$ is the acyl of a fatty acid having 14 to 22 carbon atoms, m=2 to 6, n=1 to 3, and o=1 to 3, (IV) 0 to 5% by weight of fatty acid monoalkanolamides or fatty acid dialkanolamines or fatty acid polydialkanolamides from 1 mole of a fatty acid having 12 to 18 carbon atoms and 1 mole of a monoalkanolamine having 2 to 3 carbon atoms or 1 or 2 moles of a dialkanolamine having 4 to 6 carbon atoms, (V) 0 to 5% by weight of a quanternary ammonium salt of the general formula

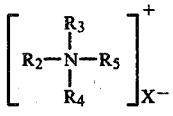

wherein $R_2$ is an aliphatic hydrocarbon radical having 12 to 18 carbon atoms, $R_3$ is an aliphatic or araliphatic hydrocarbon radical having 1 to 18 carbon atoms, $R_4$ and $R_5$ are hydrocarbon radicals having 1 to 2 carbon atoms, and $X^-$ is a salt-forming anion, (VI) 0 to 5% by weight of an ethyleneoxide adduct onto higher alcohols having 9 to 22 carbon atoms or to alkylphenols having 12 to 20 carbon atoms or to higher fatty acids or fatty acid amidopolyamines or alkylamines having 12 to 22 carbon atoms, the total of (III), (IV), (V) and (VI) being 1% to 12% by weight, (VII) 0 to 1% by weight of a protective colloid, (VIII) 0 to 10% by weight of a water-immiscible solvent, (IX) 1% to 10% by weight of a lower carboxylic acid or hydroxycarboxylic acid having 1 to 4 carbon atoms, and the (X) remainder up to 100% by weight, water.

Practical experience with the smoothing agents of the above-mentioned U.S. patent application has shown that, during the drying of the finished material, particularly during rapid or pressure drying, trouble can result from the fact that the steam-volatile constituents, particularly the fatty acid esters (I), evaporate and condense on the colder parts of the apparatus being employed.

OBJECTS OF THE INVENTION

An object of the present invention is to develop an auxiliary agent which is suitable for treating the various textile fiber materials, such as cellulose fibers, wool fibers and synthetic fibers, or mixtures thereof, and which imparts to these materials the smoothness required for further processing and a satisfactory feel and anti-static effect.

Another object of the present invention is to develop an improved smoothing agent for the treatment of textile fiber material, the use of which prevents troublesome condensations from forming on the apparatus used in the drying operation.

Another object of the present invention is the development of a smoothing agent for the treatment of textile fiber material consisting essentially of:

(Ia) from 0 to 50% by weight of a fatty acid ester from 1 mole of a fatty acid having from 8 to 18 carbon atoms and 1 mole of an alkanol having from 9 to 22 carbon atoms, (Ib) from 0 to 50% by weight of a fatty acid ester substantially free from unreacted fatty acid, said ester being prepared from up to 6 moles of a fatty acid having from 8 to 18 carbon atoms and 1 mole of an alkane polyol having from 2 to 10 carbon atoms and 2 to 6 hydroxyl groups, wherein said moles of fatty acid is in excess of said mole of alkanepolyol, (IIa) from 0 to 50% by weight of paraffin having a melting range of from 40° C. to 60° C., (IIb) from 0 to 25% by weight of a liquid paraffin, where the total of components (Ia), (Ib), (IIa) and (IIb) is from 10% to 50% by weight, (III) from 1% to 10% by weight of at least one fatty acid amidopolyamine having the formula

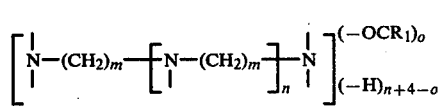

wherein —$OCR_1$ is the acyl of a fatty acid having from 14 to 22 carbon atoms, m is an integer from 2 to 6, and n and o are numbers from 1 to 3, (IV) from 0 to 5% by weight of a fatty acid monoalkanolamide, -dialkanolamide, or -polydialkanolamide from 1 mole of a fatty acid having from 12 to 18 carbon atoms and an alkanolamine selected from the group consisting of 1 mole of a monoalkanolamine having from 2 to 3 carbon atoms and 1 to 2 moles of a dialkanolamine having from 4 to 6 carbon atoms, (V) from 0 to 5% by weight of at least one quaternary ammonium salt having the formula

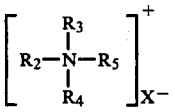

wherein $R_2$ is an aliphatic hydrocarbon having from 12 to 18 carbon atoms, $R_3$ is a member selected from the group consisting of aliphatic hydrocarbons having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35% to 85% by weight of ethylene oxide, where the total of components (III), (IV), (V) and (VI) is from 1% to 12% by weight, (VII) from 0 to 1% by weight of a protective colloid, (VIII) from 0 to 10% by weight of a water-immiscible organic solvent, (IX) from 1% to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

These and other objects of the invention will become more apparent as the description thereof proceeds.

DESCRIPTION OF THE INVENTION

Accordingly, the present invention provides a smoothing agent for textile fiber material having the following composition:

(Ia) 0 to 50% by weight of a fatty acid ester from 1 mole of a fatty acid having 8 to 18 carbon atoms and 1 mole of a monohydric alcohol having from 9 to 22 carbon atoms, (Ib) 0 to 50% by weight of a fatty acid ester substantially free from unreacted fatty acid, said ester being prepared from up to 6 moles of a fatty acid having from 8 to 18 carbon atoms and 1 mole of a polyhydric alcohol having from 2 to 10 carbon atoms, wherein said moles of fatty acid is in excess of said mole of polyhydric alcohol, (IIa) 0 to 50% by weight of paraffin having a melting range of from 40° to 60° C., (IIb) 0 to 25% by weight of a liquid paraffin, the total of (Ia), (Ib), (IIa), and (IIb) being 10% to 50% by weight, (III) 1% to 10% by weight of fatty acid amidopolyamine of the general formula

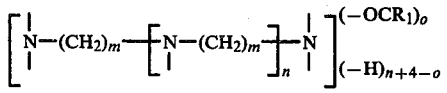

wherein —$OCR_1$ is the acyl of a fatty acid having 14 to 22 carbon atoms, m=2 to 6, n=1 to 3, and o=1 to 3, (IV) 0 to 5% by weight of fatty acid monoalkanolamides or fatty acid dialkanolamides or fatty acid polydialkanolamides from 1 mole of a fatty acid having 12 to 18 carbon atoms and 1 mole of a monoalkanolamine having 2 to 3 carbon atoms or 1 or 2 moles of a dialkanolamine having 4 to 6 carbon atoms, (V) 0 to 5% by weight of a quaternary ammonium salt of the general formula

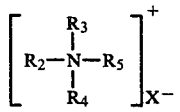

wherein $R_2$ is an aliphatic hydrocarbon radical having 12 to 18 carbon atoms, $R_3$ is an aliphatic or araliphatic hydrocarbon radical having 1 to 18 carbon atoms, $R_4$ and $R_5$ are hydrocarbon radicals having 1 to 2 carbon atoms, and $X^-$ is a salt-forming anion, (VI) 0 to 5% by weight of an ethylene oxide adduct onto higher alcohols having 9 to 22 carbon atoms or to alkylphenols having 12 to 20 carbon atoms or to higher fatty acids or fatty acid amidopolyamines or alkylamines having 12 to 22 carbon atoms, the total of (III), (IV), (V) and (VI) being 1% to 12% by weight, (VII) 0 to 1% by weight of a protective colloid, (VIII) 0 to 10% by weight of a water-immiscible solvent, (IX) 1% to 10% by weight of a lower carboxylic acid or hydroxycarboxylic acid having 1 to 4 carbon atoms, and (X) the remainder up to 100% by weight, water.

More particularly, the present invention relates to a smoothing agent for treatment of textile fiber material consisting essentially of:

(Ia) from 0 to 50% by weight of a fatty acid ester from 1 mole of a fatty acid having from 8 to 18 carbon atoms and 1 mole of an alkanol having from 9 to 22 carbon atoms, (Ib) from 0 to 50% by weight of a fatty acid ester substantially free from unreacted fatty acid, said ester being prepared from up to 6 moles, preferably 2 to 6 moles, of a fatty acid having from 8 to 18 carbon atoms and 1 mole of an alkanepolyol having from 2 to 10 carbon atoms and 2 to 6 hydroxyl groups, wherein said moles of fatty acid is in excess of said mole of alkanepolyol, (IIa) from 0 to 50% by weight of paraffin having a melting range of from 40° C. to 60° C., (IIb) from 0 to 25% by weight of a liquid paraffin, wherein the total of components (Ia), (Ib), (IIa) and (IIb) is from 10% to 50% by weight, (III) from 1% to 10% by weight of at least one fatty acid amidopolyamine having the formula

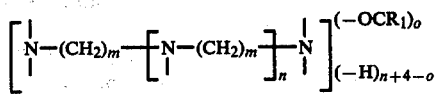

wherein $-OCR_1$ is the acyl of a fatty acid having from 14 to 22 carbon atoms, m is an integer from 2 to 6, and n and o are numbers from 1 to 3, (IV) from 0 to 5% by weight of a fatty acid monoalkanolamide, -dialkanolamide, or -polydialkanolamide from 1 mole of a fatty acid having from 12 to 18 carbon atoms and an alkanolamine selected from the group consisting of 1 mole of a monoalkanolamine having from 2 to 3 carbon atoms and 1 to 2 moles of a dialkanolamine having from 4 to 6 carbon atoms, (V) from 0 to 5% by weight of at least one quaternary ammonium salt having the formula

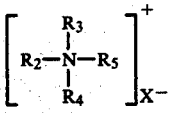

wherein $R_2$ is an aliphatic hydrocarbon having from 12 to 18 carbon atoms, $R_3$ is a member selected from the group consisting of aliphatic hydrocarbon having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35% to 85% by weight of ethylene oxide, wherein the total of components (III), (IV), (V) and (VI) is from 1% to 12% by weight, (VII) from 0 to 1% by weight of a protective colloid, (VIII) from 0 to 10% by weight of a water-immiscible organic solvent, (IX) from 1% to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

In addition, the present invention relates to an improvement in the treatment of textile fiber material to provide a smooth finish by the application of a smoothing agent, the improvement consisting of using the above smoothing agent.

Smoothing agents of the following composition are preferred:

(Ia) 0 to 20% by weight of the fatty acid esters of monohydric alcohols, (Ib) 0 to 20% by weight of the fatty acid esters of polyhydric alcohols, (IIa) 10% to 50% by weight of a paraffin of the melting range 50° to 60° C., (IIb) 0 to 10% by weight of the liquid paraffin, (III) 2% to 8.0% by weight of the fatty acid amidopolyamine, (IV) 0.5% to 2.0% by weight of the fatty acid dialkanolamide or polydialkanolamide, (V) 0 to 2.5% by weight of the quaternary ammonium salt, (VI) 0.1% to 3.0% by weight of an adduct of 35% to 85% by weight of ethylene oxide adducted to a higher fatty alcohol having 16 to 18 carbon atoms, or to nonylphenol, (VII) 0 to 0.1% by weight of a protective colloid, (VIII) 0 to 4% by weight of a water-immiscible organic solvent, (IX) 2% to 8% by weight of concentrated acetic acid, and the (X) remainder to 100% by weight, water.

These smoothing agents constitute storage-stable, aqueous cationic dispersions whose specific substantivity especially enables the smoothing agents to be applied to fibers by the bath exhaustion method.

Suitable fatty acid esters of component (Ia) are fatty acid esters from 1 mole of a fatty acid having from 8 to 18 carbon atoms and 1 mole of an alkanol having from 9 to 22 carbon atoms, in particular palmitic acid or stearic acid esters with straight- or branched chain alkanols of $C_{12}$–$C_{18}$ chain length, more particularly isotridecyl stearate. The fatty acids include the iso acids such as isopalmitic acid.

Suitable fatty acid esters of component (Ib) are fatty acid esters from up to 6 moles of a fatty acid having from 8 to 18 carbon atoms and 1 mole of an alkanepolyol having from 2 to 10 carbon atoms and 2 to 6 hydroxyl groups, in particular, partial or full esters of fatty acids having $C_{12}$ to $C_{18}$ chain lengths with ethylene glycol, propylene glycol, glycerine, or pentaerythritol. The partial esters used are preferably those obtained from 3 to 4 moles of fatty acid and 1 mole of pentaerythritol, as for example those obtained from fatty acid mixtures consisting of approximately 50 weight % caprylic acid, 40 weight % capric acid and 10 weight % lauric acid.

The paraffins (IIa) used are preferably those having a melting range of from 50° C. to 60° C.

Suitable liquid paraffins are, for example, vaseline oils having a viscosity range of from 30 to 80 cSt.

The fatty acid amidopolyamines of component (III) are obtained preferably from saturated fatty acids or mixtures of fatty acids having 16 to 22 carbon atoms with polyalkylene polyamines having the formula $$H_2N-(CH_2)_m-[NH-(CH_2)_m]_n-NH_2$$

wherein m and n have the above-assigned values, such as diethylene triamine, dipropylene triamine, triethylene tetraamine, tripropylene tetraamine, tetraethylene pentamine and tetrapropylene pentamine. The reaction is effected in a molar ratio such that at least one amino nitrogen atom, capable of salt formation, remains. The product of reaction from 2 moles of stearic acid with 1 mole of diethylenetriamine may be mentioned by way of example. The preferred fatty acid amidopolyamines are those which have mixed acyl radicals of $C_{16}$–$C_{18}$ carbon atoms chain lengths and in which m, n and O=2 to 3. The fatty acid amidopolyamines in the smoothing agent composition of the invention are present in the form of salts thereof with lower carboxylic acids or hydroxycarboxylic acids having 1 to 4 carbon atoms, such as acetic acid or glycolic acid, presented as component (IX).

Fatty acid monoalkanolamides or fatty acid dialkanolamides or fatty acid polydialkanolamides corresponding to component (IV) are obtained by condensation of 1 mole of a monoalkanolamine or 1 to 2 moles of a dialkanolamine, such as monoethanolamine or diethanolamine or dipropanolamine, with 1 mole of fatty acid, mixtures of fatty acids or the corresponding fatty acid methyl esters, such as fatty acids having 12 to 20 carbon atoms (see Lindner, "Tenside-Textilhilfsmittel-Waschrohstoffe" [1967] pages 904 to 912). Examples of these are condensation products from 1 mole of lauric acid and 1 mole of monoethanolamine, from 1 mole of coconut fatty acid and 2 moles of diethanolamine, from 1 mole of lauric acid or oleic acid and 1 mole of diethanolamine, or from 1 mole of coconut fatty acid and 1 mole of dipropanolamine.

Suitable quaternary ammonium salts of component (V) are those of the formula

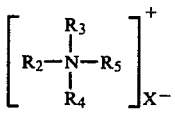

wherein $R_2$ is an aliphatic hydrocarbon having from 12 to 18 carbon atoms, particularly alkyl and alkenyl, $R_3$ is a member selected from the group consisting of aliphatic hydrocarbons having from 1 to 18 carbon atoms, particularly alkyl having from 1 to 18 carbon atoms and alkenyl having from 2 to 18 carbon atoms, phenylalkyl having from 7 to 18 carbon atoms, particularly benzyl, and alkylphenylalkyl having from 8 to 18 carbon atoms, $R_4$ and $R_5$ are methyl or ethyl, and $X^-$ is a salt-forming anion, particularly a halide, a methosulfate or an ethosulfate. The following are representative quaternary ammonium compounds: lauryltrimethyl ammonium chloride, dodecylbenzyltrimethyl ammonium methosulfate or distearyl-dimethyl-ammonium chloride.

The smoothing agent compositions also can contain from 0 to 5% by weight, preferably 0.1% to 3.0% by weight, of an ethylene oxide adduct to a compound having a replaceable hydrogen and at least 9 carbon atoms, such as straight or branched chain, saturated or unsaturated higher alcohols having 9 to 22, preferably 16 to 18, carbon atoms, particularly alkanols and alkenols, such as the adduct of 20 moles of ethylene oxide to 1 mole of oleyl alcohol or to alkylphenols having 12 to 20 carbon atoms, such as the adduct of 10 moles of ethylene oxide to nonylphenol or to higher fatty acids having 12 to 22 carbon atoms, such as the adduct of 15 moles of ethylene oxide to tallow fatty acids, or to fatty acid amidopolyamines or alkylamines having 12 to 22 carbon atoms, or mixtures of these adducts. The ethylene oxide content of the adducts should be 35% to 85% by weight. The ethylene oxide adducts to higher fatty alcohols and alkylphenols such as nonylphenol are preferred, as component (VI).

The protective colloids of component (VII) are preferably cellulose ethers, such as methylcellulose or hydroxyethylcellulose, glue, polyvinyl alcohol or gum arabic.

Suitable solvents of component (VIII) which are immiscible in water are the aliphatic or aromatic hydrocarbons having 5 to 10 carbon atoms, such as hexane, benzene, toluene, xylene, alkylbenzene; symmetric or asymmetric ketones, particularly lower alkanones, such as diisobutylketone, symmetric or asymmetric ethers, particularly lower alkyl ethers, such as dibutyl ether, or halogenated hydrocarbons, such as trichloroethylene or perchloroethylene.

The lower carboxylic acids of component (IX) serve to form salts with the fatty acid amidopolyamines or to neutralize other basic constituents of the composition and, advantageously, should be used in a quantity of from 3 to 8 moles per amino nitrogen equivalent. Preferably, these acids are alkanoic acids having from 1 to 4 carbon atoms and hydroxyalkanoic acids having from 2 to 4 carbon atoms. By way of example, acetic acid or glycolic acid are suitable.

The composition is made up to 100% by weight with water (X) and is converted into a stable dispersion. This can be effected in a conventional manner by agitation, at elevated temperatures, if required, with the use of agitators, dispersers, homogenizers, etc. Preferably, distilled or demineralized water is used.

The smoothing agents, claimed in accordance with the invention, can be used for the finishing of textile fiber materials, such as wool, cotton, rayon, polyacrylonitrile fiber, polyester fiber, polyamide fiber, triacetate fiber, polyethylene fiber, or polypropylene fiber materials and mixtures thereof, preferably mixtures of polyacrylonitrile/wool, polyacrylonitrile/cotton, polyester/wool, polyester/rayon and polyamide/wool, and mixtures of mineral fiber material, such as asbestos or glass fibers, preferably glass fiber material. Preferably, the fiber materials are present in the form of cross-wound bobbins, rocket bobbins, hank yarn, muffs or combed sliver or slubbing.

The material may be bleached, dyed and/or finished so as to be shrink free.

The smoothing agents can be applied in conventional apparatus, such as dyeing apparatus for cross-wound bobbins, rocket bobbins, hank yarn, muffs, or on the backwashing machine for combed sliver. Advantageously, work is carried out by the bath exhaust process for an aqueous liquor with a goods/liquor ratio of 1:8 to 1:40 and a liquor pH of 2 to 8, preferably 4.5 to 6.5, in an HT apparatus, or 6.5 to 7.5 in open apparatus, at a temperature between 25° C. and 80° C., the concentration being 0.2% to 3.0%, preferably 0.2% to 1.5%, by weight of smoothing agent, based on the active smoothing agent substances relative to the weight of the goods.

Finishing can also be effected in the presence of electrolytes, such as sodium acetate, sodium sulfate, sodium chloride, etc.

The finished material has excellent smoothness, and a soft, voluminous and supple feel, so that there is no need for an additional application of scrooping agents. The smoothness values or friction values, measured on the friction value balance manufactured by the firm Schlafhorst, are below 0.18 My in all the textile fiber materials, preferably 0.12 to 0.15 My, and have a high degree of uniformity. This results in very satisfactory workability when, for example, knitting or weaving. Furthermore, no difficulties are caused by electrostatic charging when further processing the finished textile fiber materials. The knitted and woven articles made from yarns of this type exhibit satisfactory and smooth stitches. The smoothing agents, claimed in accordance with the invention, are particularly suitable for use in those cases in which the finished material is dried at relatively high temperatures by, for example, the rapid drying or pressure drying method.

The present invention will now be further described by means of the following examples of smoothing agents made in accordance with the present invention and their uses. These examples are not to be deemed limitative of the invention in any respect.

EXAMPLE

Examples 1 to 6 are examples of various smoothing agent compositions of the invention. The ingredients in each of the compositions were mixed and dispersed to form a stable aqueous dispersion:

EXAMPLE 1

| | Percent By Weight | Component |
|---|---|---|
| Isotridecyl stearate | 12.0 | Ia |
| Paraffin, m.p. 52° to 54° C. | 18.0 | IIa |
| Fatty acid amidopolyamine of formula (III), wherein —$OCR_1$ is the acyl radical of a fatty acid having the carbon chain distribution: $C_{16}$ = 20%, $C_{18}$ = 40%, $C_{20}$ = 10%, $C_{22}$ = 30% and m = 2, n = 3, o = 3. | 4.8 | III |
| Coconut fatty acid diethanolamide | 1.0 | IV |
| Hydro-tallow alcohol . 20 EO | 0.2 | VI |
| Acetic acid, 60% solution | 4.8 | IX |
| Water | 59.2 | X |

EXAMPLE 2

| | Percent By Weight | Component |
|---|---|---|
| Paraffin, m.p. 52° to 54° C. | 30.0 | IIa |
| Fatty acid amidopolyamine of formula (III), wherein —$OCR_1$ is the acyl radical of a fatty acid having the carbon chain distribution: $C_{16}$ = 25%, $C_{18}$ = 35%, $C_{20}$ = 15% $C_{22}$ = 35% and m = 2, n = 2, o = 2. | 4.0 | III |
| Fatty acid alkanolamide from 1 mole of coconut fatty acids and 2 moles of diethanolamine | 1.0 | IV |
| Fatty acid amidopolyamine ethoxylate, from the fatty acid amidopolyamine having the carbon chain length distribution of component III of this example, and which contains approximately 43% by weight of EO | 1.0 | VI |
| An adduct of 1 mole of a fatty alcohol mixture having $C_{16}$–$C_{18}$ chain lengths and 5.1 moles of EO which has A HLB value of 10 | 1.0 | VI |
| Acetic acid, 60% solution | 2.8 | IX |
| Water | 60.2 | X |

EXAMPLE 3

| | Percent By Weight | Component |
|---|---|---|
| Paraffin, m.p. 52° to 54° C. | 24.5 | IIa |

-continued

| | Percent By Weight | Component |
|---|---|---|
| Vaseline oil, 40 cSt | 5.5 | IIb |
| Fatty acid amidopolyamine of Example 1 | 4.0 | III |
| Fatty acid alkanolamide from 1 mole of coconut fatty acids and 2 moles of diethanolamine | 0.9 | IV |
| Acetic acid, 60% solution | 0.4 | IX |
| Water | 61.1 | X |

EXAMPLE 4

| | Percent By Weight | Component |
|---|---|---|
| Isotridecyl stearate | 10.0 | Ia |
| Paraffin, m.p. 54°–56° C. | 20.0 | IIa |
| Fatty acid amidopolyamine of formula III, wherein —$OCR_1$ is the acyl radical of a fatty acid having the carbon chain length distribution: $C_{14}$ = 2%, $C_{16}$ = 16%, $C_{18}$ = 42%, $C_{20}$ = 20%, $C_{22}$ = 18%. The acid number is 27 as a result of free fatty acid still present. m = 2; n = 3; o = 3. | 5.4 | III |
| Coconut fatty acid polydiethanolamide | 1.0 | IV |
| Cetyl stearyl alcohol . 20 EO | 0.2 | VI |
| Acetic acid | 3.5 | IX |
| Water | 59.9 | X |

EXAMPLE 5

| | | |
|---|---|---|
| Pentaerythritol-tetra-carboxylic acid ester, wherein the carboxylic acid is a mixture of 50% by weight of caprylic acid, 40% by weight of capric acid and 10% by weight of lauric acid. | 12.5 | Ib |
| Paraffin, m.p. 50°–52° C. | 12.5 | IIa |
| Fatty acid amidopolyamine of Example 1 | 4.0 | III |
| Coconut fatty acid polydiethanolamide | 0.7 | IV |
| Nonylbenzyltrimethyl ammonium chloride | 0.5 | V |
| Diisobutyl ketone | 2.0 | VIII |
| Acetic acid, 60% solution | 5.7 | IX |
| Water | 62.1 | X |

EXAMPLE 6

| | Percent By Weight | Component |
|---|---|---|
| Isotridecyl palmitate | 7.0 | Ia |
| Paraffin, m.p. 50°–52° C. | 23.0 | IIa |
| Fatty acid amidopolyamine of Example 1 | 3.8 | III |
| Fatty acid alkanolamide from 1 mole of lauric acid and 2 moles of diethanolamine | 1.0 | IV |
| Acetic acid, 45% solution | 6.0 | IX |
| Polyvinyl alcohol 10%, solution | 5.0 | VIII |

-continued

| | Percent By Weight | Component |
|---|---|---|
| Water | 54.2 | X |

The smoothing agents of Examples 1 to 6 are stable dispersions which are miscible with water in any ratio.

The following are examples of the use of the smoothing agents of the invention.

EXAMPLE 7

After prior dyeing and rinsing, wool yarn was treated in a cross-wound bobbin HT dyeing apparatus at 40° C. and a liquor ratio of 1:10 with a liquor which had a pH value of 6.0 and which contained 2% of the smoothing agent of Example 1, based on the weight of the goods. After 20 minutes of alternating circulation, the smoothing agent was uniformly applied to the yarn.

The yarn was subsequently centrifuged and dried in a quick-dryer; no evaporation of the components of the smoothing agent was detected.

The yarn obtained in this manner could be further processed in a trouble-free manner to provide a high-quality knitted fabric.

EXAMPLE 8

After thorough rinsing and deacidification, a dyed cotton material was finished for 10 minutes at 50° C. with a liquor (liquor pH value 5.5) containing 1.5% of the smoothing agent of Example 2 (based on the weight of the goods). The smoothing agent was fully attached to the yarn with excellent uniformity.

After centrifuging, drying was effected in a pressure dryer. No deposits of volatile smoothing agent could be observed at any location in the drying apparatus.

Owing to the excellent smoothness (friction value=0.18 My), the material could be further processed in a satisfactory manner.

EXAMPLE 9

Highly swollen polyacrylonitrile yarn, which had been cationically dyed in a conventional manner in an open dyeing apparatus and subsequently cold-rinsed at 50° C., was treated for 20 minutes with a circulating liquor which had been adjusted to a pH value of from 6.8 to 7.3 and which contained 1.8% of the smoothing agent of Example 3, based on the weight of the goods. During this period of time, the smoothing agent was quantitatively applied to the fibrous material as shown by the fact that the treatment liquor became completely free from turbidity.

After centrifuging, the material was dehydrated in a dryer conventionally used for highly swollen yarn.

The yarn finished in this manner was distinguished by excellent smoothness (friction value=0.16 My) and by a pleasant feel.

EXAMPLE 10

Rocket bobbins having a mixed yarn of polyacrylonitrile/wool were dyed in a conventional manner and then treated for 20 minutes at a liquor ratio of 1:12 with a liquor which had been adjusted to a pH value of from 5.5 to 6.0 and which contained 2% of th smoothing agent of Example 4, based on the weight of the goods, with increasing temperature (to 45° C.).

The material could be dehydrated without difficulty in a rapid dryer. The knitted article made from the yarn (friction value=0.15 My) had a voluminous feel and was free from knots.

EXAMPLE 11

PAC yarn was dyed in a dyeing apparatus with a liquor ratio of 1:10 and was at the same time finished with the smoothing agent of Example 6.

The dyeing/finishing bath contained, relative to the weight of the goods:

0.15% of Astrazon yellow 7 GLL (R)
0.10% of Astrazon-red GTL (R)
0.10% of Astrazon blue 5 GL (R)
4.0% of acetic acid, 30% solution
5.0% of Glauber salt
1.0% of commercially available retarder
0.3% of commercially available, nonionic dispersing agent
1.5% of the smoothing agent of Example 6
0.5% of commercially available, cationic softener.

The yarn was placed into the dyeing/finishing bath at 80° C., heated to 98° C. for 30 minutes with the apparatus closed, dyed and finished at this temperature for 15 minutes, then cooled to approximately 50° C., rinsed with cold water, and the material thus finished was centrifuged and dried in a rapid dryer until it reached 110° C. No trouble occurred during the drying operation, and the material was dyed uniformly and had excellent smoothness and a soft, supple feel.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A smoothing agent for the treatment of textile fiber material consisting essentially of:

(Ia) from 0 to 50% by weight of a fatty acid ester from 1 mole of a fatty acid having from 8 to 18 carbon atoms and 1 mole of an alkanol having from 9 to 22 carbon atoms, (Ib) from 0 to 50% by weight of a fatty acid ester substantially free from unreacted fatty acid, said ester being prepared from up to 6 moles of a fatty acid having from 8 to 18 carbon atoms and 1 mole of an alkanepolyol having from 2 to 10 carbon atoms and 2 to 6 hydroxyl groups, wherein said moles of fatty acid is in excess of said mole of alkanepolyol, (IIa) from 10 to 50% by weight of paraffin having a melting range of from 40° C. to 60° C., (IIb) from 0 to 25% by weight of a liquid paraffin, wherein the total of components (Ia), (Ib), (IIa) and (IIb) is from 10% to 50% by weight, (III) from 1% to 10% by weight of at least one fatty acid amidopolyamine having the formula

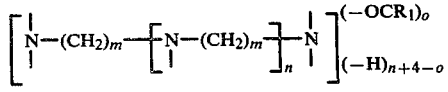

wherein —$OCR_1$ is the acyl of a fatty acid having from 14 to 22 carbon atoms, m is an integer from 2 to 6, and n and o are numbers from 1 to 3, (IV) from 0 to 5% by weight of a fatty acid monoalkanolamide, -dialkanolamide, or -polydialkanolamide from 1 mole of a fatty acid having from 12 to 18 carbon atoms and an alkanolamine selected from the group consisting of 1 mole of a monoalkanolamine having from 2 to 3 carbon atoms and 1 to 2 moles of a dialkanolamine having from 4 to 6 carbon atoms, (V) from 0 to 5% by weight of at least one quaternary ammonium salt having the formula

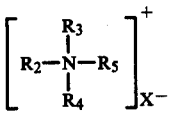

wherein $R_2$ is an aliphatic hydrocarbon having from 12 to 18 carbon atoms, $R_3$ is a member selected from the group consisting of aliphatic hydrocarbon having from 1 to 18 carbon atoms, phenylalkyl having from 7 to 18 carbon atoms and alkylphenylalkyl having from 8 to 18 carbon atoms, $R_4$ and $R_5$ are alkyl having 1 to 2 carbon atoms, and $X^-$ is a salt-forming anion, (VI) from 0 to 5% by weight of an ethylene oxide adduct to a compound having a replaceable hydrogen selected from the group consisting of aliphatic hydrocarbon alcohols having 9 to 22 carbon atoms, alkylphenols having from 12 to 20 carbon atoms, fatty acids having from 12 to 22 carbon atoms, higher fatty acid amides with alkylene diamines and dialkylene triamines having a total of from 12 to 22 carbon atoms, and alkylamines having from 12 to 22 carbon atoms, having from 35% to 85% by weight of ethylene oxide, wherein the total of components (III), (IV), (V) and (VI) is from 1% to 12% by weight, (VII) from 0 to 1% by weight of a protective colloid, (VIII) from 0 to 10% by weight of a water-immiscible organic solvent, (IX) from 1% to 10% by weight of an acid selected from the group consisting of alkanoic acids having from 1 to 4 carbon atoms and hydroxyalkanoic acids having from 2 to 4 carbon atoms, and (X) the remainder to 100% by weight, water.

2. The smoothing agent of claim 1 wherein said component (Ia) is a fatty acid ester from 1 mole of a fatty acid selected from the group consisting of palmitic acid and stearic acid and 1 mole of an alkanol having from 12 to 18 carbon atoms.

3. The smoothing agent of claim 1 wherein said component (Ia) is isotridecyl stearate.

4. The smoothing agent of claim 1 wherein said component (Ib) is a partial or full ester from a fatty acid having from 12 to 18 carbon atoms and an alkanepolyol selected from the group consisting of ethylene glycol, propylene glycol, glycerine, and pentaerythritol.

5. The smoothing agent of claim 1 wherein said component (Ib) is a partial ester of pentaerythritol.

6. The smoothing agent of claim 1 wherein said component (Ib) is a partial ester from 3 to 4 moles of a fatty acid and 1 mole of pentaerythritol.

7. The smoothing agent of claim 1 wherein said component (IIa) is a paraffin having a melting range of from 50° C. to 60° C.

8. The smoothing agent of claim 1 wherein said component (IIb) is a vaseline oil having a viscosity range of from 30 to 80 cSt.

9. The smoothing agent of claim 1 wherein said component (III) is a fatty acid amidopolyamine where $—OCR_1$ is the acyl of mixed fatty acids having 16 to 18 carbon atoms and where m, n and o=2 to 3.

10. The smoothing agent of claim 1 consisting essentially of:

(Ia) 0 to 20% by weight of said fatty acid esters of monohydric alcohols, (Ib) 0 to 20% by weight of said fatty acid esters of polyhydric alcohols, (IIa) 10% to 50% by weight of said paraffin of the melting range 50° to 60° C., (IIb) 0 to 10% by weight of said liquid paraffin, (III) 2% to 8.0% by weight of said fatty acid amidopolyamine, (IV) 0.5% to 2.0% by weight of said fatty acid dialkanolamide or polydialkanolamide, (V) 0 to 2.5% by weight of said quaternary ammonium salt, (VI) 0.1% to 3.0% by weight of said adduct of 35% to 85% by weight of ethylene oxide adducted to a higher fatty alcohol having 16 to 18 carbon atoms, or to nonylphenol, (VII) 0 to 0.1% by weight of said protective colloid, (VIII) 0 to 4% by weight of said water-immiscible organic solvent, (IX) 2% to 8% by weight of concentrated acetic acid, and (X) the remainder to 100% by weight, water.

11. The smoothing agent of claim 10 wherein said component (VII) is a member selected from the group consisting of cellulose ethers, glue, polyvinyl alcohol and gum arabic.

12. In the process of treating textile fiber material to lubricate the same comprising the steps of contacting a textile fiber material with a smoothing agent and recovering said lubricated textile fiber material, the improvement consisting of using from 0.2% to 3.0%, based on the active smoothing agent substances relative to the weight of the goods, of the smoothing agent of claim 1, as said smoothing agent.

13. The process of claim 12 wherein said smoothing agent is contacted with said textile fiber material by the bath exhaustion method.

14. The process of claim 12 wherein said smoothing agent is contacted with said textile fiber material by a spraying process.

15. The process of claim 12 wherein said smoothing agent is contacted with said textile fiber material by an immersion process.

* * * * *